United States Patent [19]

Fastert et al.

[11] 3,974,874

[45] Aug. 17, 1976

[54] CONTINUOUS CASTING PLANT

[75] Inventors: Herbert Fastert, Wyckoff, N.J.; Wolfgang John, New York, N.Y.; Karl L. Backhaus, West New York, N.J.

[73] Assignee: Concast Incorporated, Montvale, N.J.

[22] Filed: Nov. 24, 1975

[21] Appl. No.: 634,842

[52] U.S. Cl. ..... 164/281 R

[51] Int. Cl.[2] ..... B22D 11/10

[58] Field of Search ..... 164/281, 82

[56] References Cited

UNITED STATES PATENTS

| | | | |
|---|---|---|---|
| 3,273,208 | 9/1966 | Greenberger | 164/281 |
| 3,344,847 | 10/1967 | Beemer | 164/281 |
| 3,552,902 | 1/1971 | Schoffmann et al. | 164/281 |
| 3,782,447 | 1/1974 | Willim et al. | 164/281 |

FOREIGN PATENTS OR APPLICATIONS

| | | | |
|---|---|---|---|
| 1,964,231 | 7/1971 | Germany | 164/281 |

*Primary Examiner*—Ronald J. Shore

*Attorney, Agent, or Firm*—Nichol M. Sandoe

[57] ABSTRACT

In a continuous casting plant having a ladle shop and a separate casting shop, each served by a separate traveling crane, means for supporting one or more ladles are located in the ladle shop and means for supporting one or more molds are located in the casting shop. A tundish is positioned to extend across the space between the two shops with one end of the tundish located below a ladle to receive molten metal therefrom, and with the other end located above the mold to discharge molten metal into the mold. One or more tundishes are mounted on pivoted carriers on which the tundishes may be moved selectively from casting position to a position in the casting shop where they may be removed from the carriers for repair and reconditioning, and on which tundishes may be moved to preheating and prefill positions.

9 Claims, 4 Drawing Figures

Figure 2:
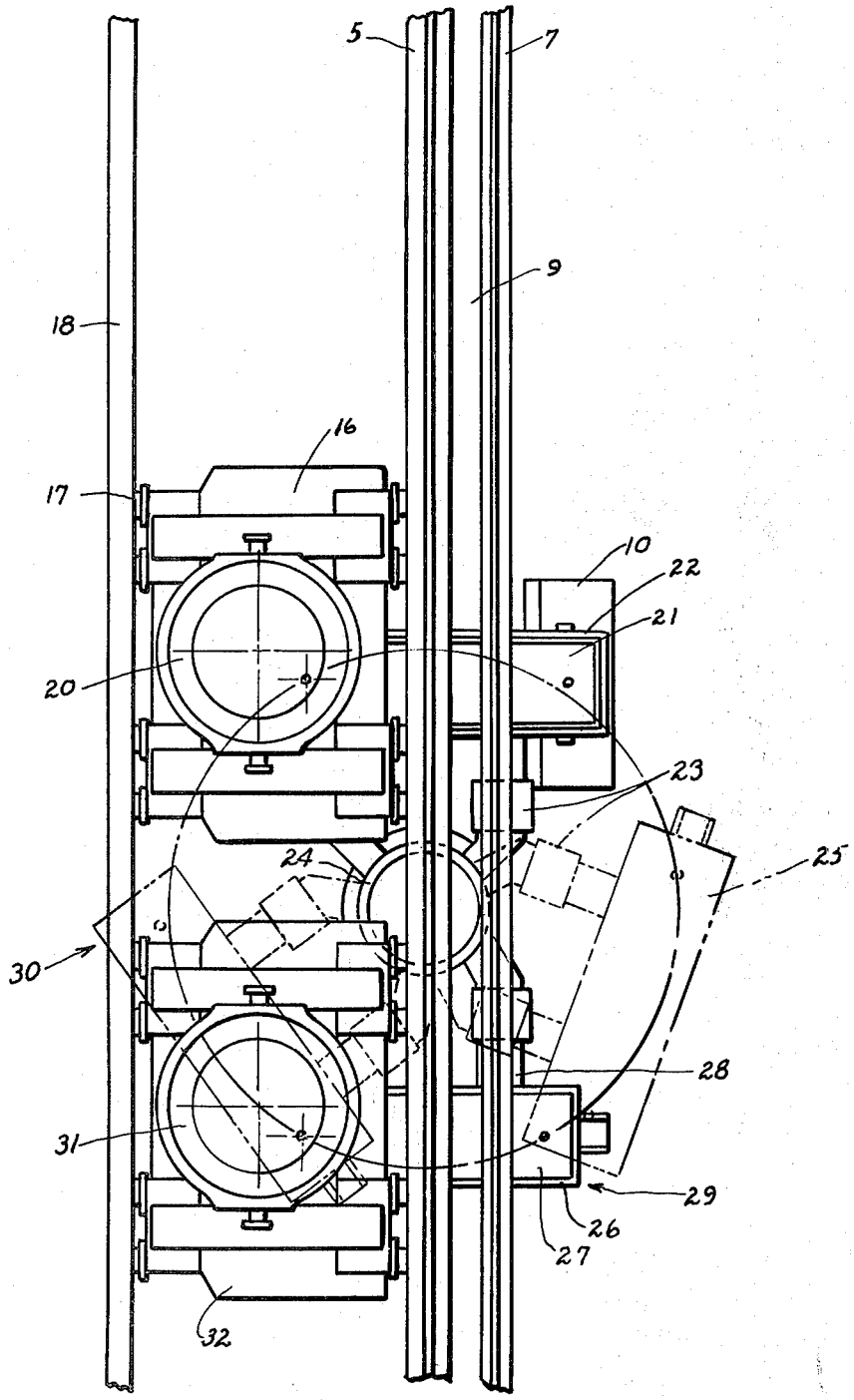

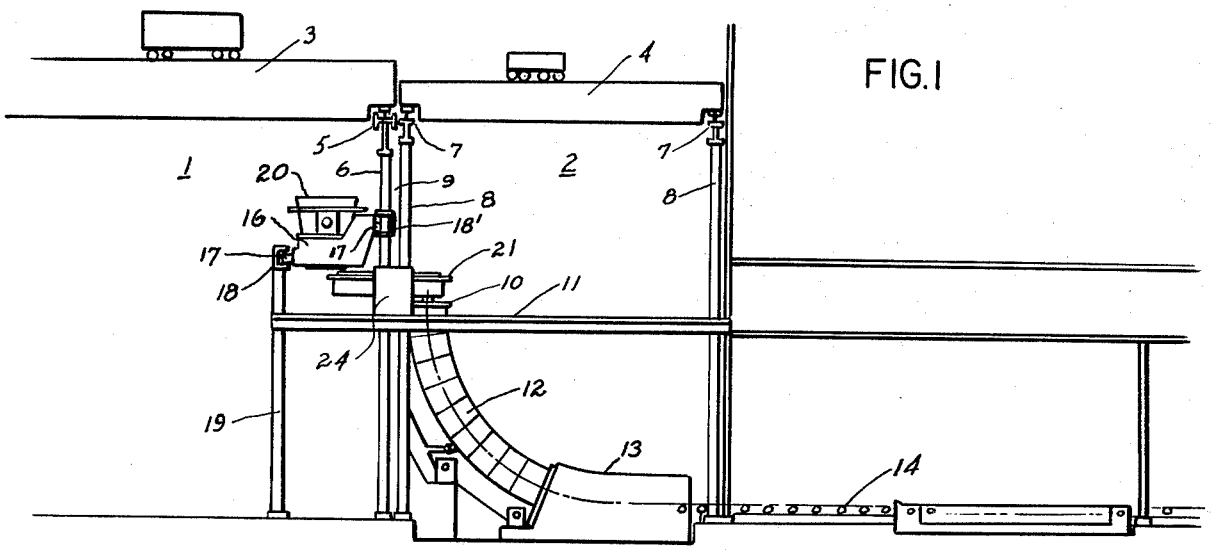
FIG.1
FIG.3
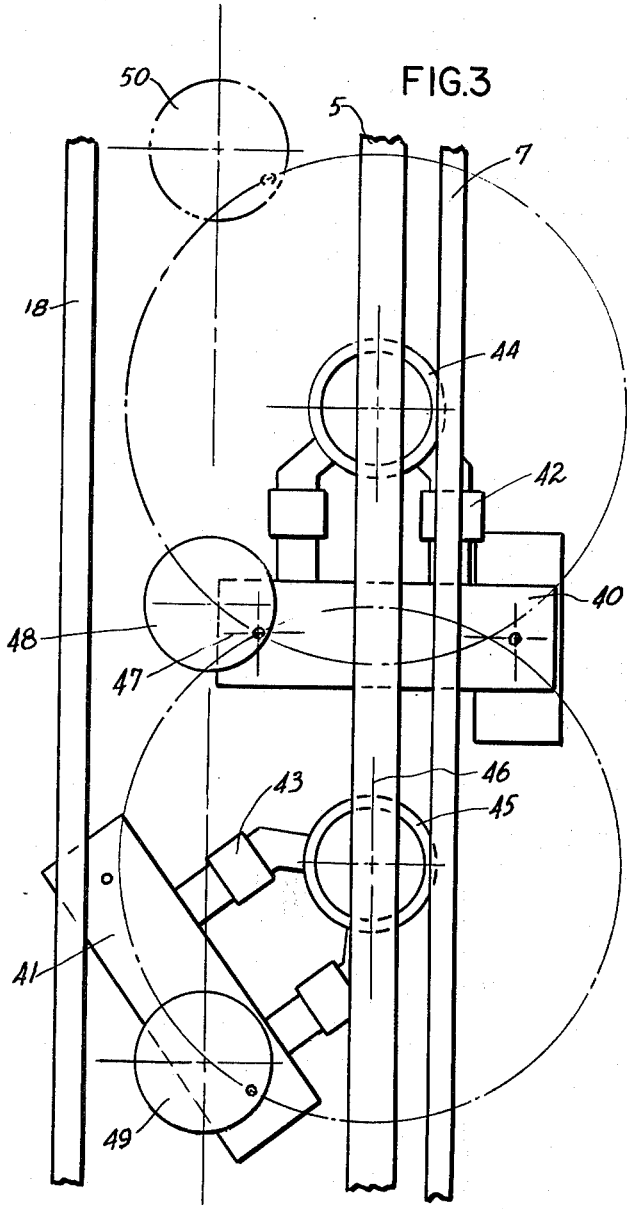
FIG.4
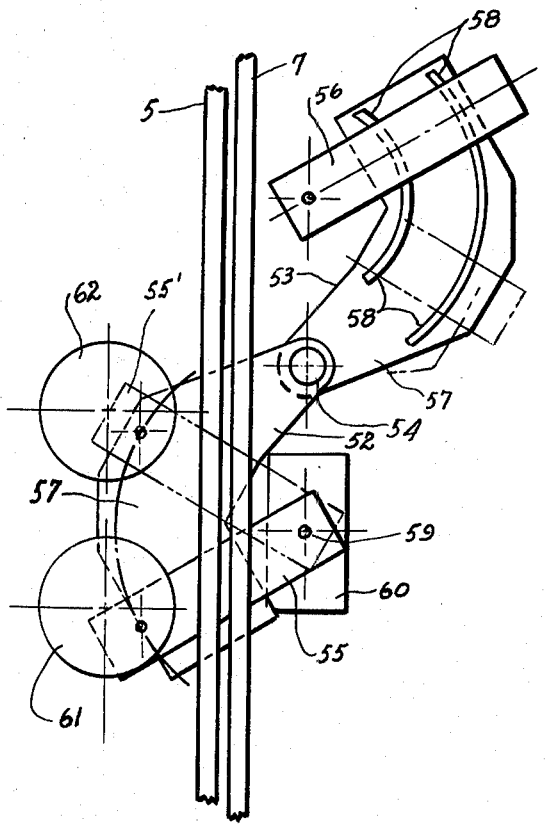

CONTINUOUS CASTING PLANT

This invention relates to continuous casting plants and pertains particularly to arrangements of ladles, tundishes and casting molds adapted to improve the convenience and efficiency of operation of the plant.

In continuous casting plants, the molten metal to be cast is transported by traveling crane in a ladle to the casting machine where it is poured from the ladle into a tundish from which it flows at a controlled rate into the upper end of a chilled casting mold. In such plants, efficient continuous operation requires arrangements for the quick replacement of a worn tundish with a new or reconditioned tundish so that the casting operation need be interrupted only for a short period of time. Efficient operation also requires arrangements for the rapid removal of an empty ladle and its replacement by a full ladle.

Modern continuous casting plants usually comprise two adjoining shops, one of which is known as a ladle shop and the other of which is known as a casting shop. Each shop is provided with its own traveling crane, each operating along its own pair of tracks, with the pairs of tracks extending parallel to each other. The pairs of tracks are spaced apart slightly to permit each of the two cranes to travel independently within its own shop without interfering with the travel of the other within its shop. Thus, the two shops are separated from each other, not necessarily physically as by a barrier such as a wall, but functionally by the space between the pairs of crane tracks which defines a separation zone between the shops. Thus, all of the functions of ladle movement and handling may be performed in the ladle shop by the ladle shop crane, while all the functions incident to the actual casting operation may be performed in the casting shop by the casting shop crane. Such functions include removal of a worn tundish and replacement by a new or reconditioned tundish, or exchanging molds and adjacent roller apron segments or other parts of the machine.

Although the two separate shop arrangement has made possible considerable improvement in operating efficiency over the prior single shop arrangement using only a single traveling crane, it has nevertheless required the use of cross-transfer equipment to transport ladles from the ladle shop into the casting shop so that metal may be poured from a ladle into a tundish in the casting shop. Alternatively, the tundish and mold has been placed in the ladle shop, and provision has been made for transporting tundishes from one shop to the other when replacement and repair becomes necessary.

One type of cross-transfer equipment consists of a ladle turret having a vertical shaft located between the shops and carrying two oppositely disposed arms pivotally mounted on said shaft with one arm extending into the ladle shop ready to receive a new full ladle, and with the other arm extending into the casting shop and carrying a ladle in position to pour into a tundish. When the latter ladle is empty, the arms may be rotated 180° to bring a full ladle from the ladle shop into the casting shop to a position to pour into the mold, and to bring the empty ladle into the ladle shop to be picked up by the crane for refilling.

Another type of cross-transfer equipment utilizes cross-transfer cars which move on rails and transport full ladles from the ladle shop to the casting shop, and empty ladles from the casting shop to the ladle shop.

Such cross-transfer equipment, however, is expensive and does not solve the problems of replacement of worn tundishes or molds satisfactorily. A possible solution of such problems has been suggested in U.S. Pat. No. 3,782,447 in which two separate shops are provided, one of which is designated as a casting shop and the other of which is designated as a side shop. The casting mold and the tundish which supplies it are located in the casting shop and the ladles are transported by a ladle crane in the casting shop. Tundishes are carried on tundish cars traveling on rails from one shop to the other so that worn tundishes may be moved from the casting shop to the side shop and new or reconditioned tundishes may be moved from the side shop to the casting shop. Tundishes are repaired and preheated in the side shop and are moved and handled by a separate crane in that shop. In this arrangement, however, the ladle crane must perform duties other than the transport of ladles. It must, for example, be available to handle the exchange of molds and roller apron segments.

It is an object of the present invention to eliminate the need for cross-transfer equipment, and to relieve the ladle crane from any duties other than the transport of full and empty ladles to and from the casting station.

A preferred embodiment of the invention is shown in the accompanying drawings, together with modifications thereof, in which, FIG. 1 is a side elevation of a continuous casting plant, FIG. 2 is a top plan view of the casting unit including ladles, tundishes and mold and showing the separation zone between the ladle shop and the casting shop, FIG. 3 is a similar view of a modified form of the invention, and FIG. 4 is a similar view of another modified form of the invention.

Referring to FIG. 1, the casting apparatus is shown as arranged in a building comprising a ladle shop 1 and a casting shop 2. A ladle crane 3 is located in the ladle shop and a casting crane 4 is located in the casting shop. The ladle crane 3 is mounted on and travels along tracks 5 supported on vertical columns 6, and the casting crane 4 is mounted on and travels along tracks 7 supported on vertical columns 8. As shown, the cranes and their respective opposed inside tracks and supporting columns are separated by a space 9 defining a separation zone between the ladle shop and the casting shop.

The mold 10 is supported in the casting shop on a platform 11 and the partially solidified casting which is discharged from the mold moves through a curved secondary cooling zone 12 of conventional type and thence through a stand of straightening and withdrawal rolls 13, from which the casting is delivered to a conveyor 14 which transports it to a cutting station.

A ladle car 16 is provided with rollers 17 which ride on rails 18, 18' which are supported on columns 6 and 19, respectively, and which extend transversely to permit a ladle 20 to be moved transversely into and out of casting position when necessary, as when it is desired to replace an empty ladle with a full one.

The gist of the invention consists in the provision of a tundish 21 extending across the separation zone 9 and located at a casting station extending from the ladle shop into the casting shop with one end of the tundish located below the ladle outlet to receive metal flowing from the ladle and the other end of the tundish located above the mold in position to discharge metal through its outlet opening into the mold. Thus, with the tundish at the casting station, metal received from the ladle in the ladle shop can flow in the tundish across the separation zone and be discharged into the mold in the casting shop. For reasons of simplicity, the illustrated example shows only one tundish outlet serving a single mold, but the tundish may be provided with a plurality of outlets serving a single mold or a plurality of molds, in which case the tundish width may be increased towards the outlet end.

As shown in FIG. 2, the tundish 21 is carried by a tundish carrier 22 which is mounted on a pair of swing arms 23 rotatably mounted on a shaft 24 supported on the platform 11. Thus, when the tundish at the casting station becomes worn, it may be swung from casting position to a removal position shown in broken lines indicated by numeral 25 where it is clear of obstruction and may be removed from its carrier by the casting shop crane and transported to a repair station and a reconditioned tundish may be placed on the carrier.

Preferably, a second tundish carrier 26 carrying a second tundish 27 is also mounted on a second pair of swing arms 28 also rotatably mounted on shaft 24. Thereby, as soon as the carrier 22 carrying the tundish 21 has been swung out of the casting position, the carrier 26 carrying the tundish 27 may be swung to the original casting position of the tundish 21 and the casting operation may be resumed.

It will be understood that during the time when any tundish is located in the casting position above the mold, a second tundish may be placed in the tundish carrier attached to a second pair of swing arms such as the arms 28 which are rotatably mounted on shaft 24 while the carrier is in the removal position indicated by 25. The second tundish may then be swung to a preheat station indicated by numeral 29 and thence to a tundish prefill station 30. As shown in FIG. 2, a ladle 31 is carried on a ladle car 32 on which it has been deposited by the ladle crane 3. In this position, the second tundish 27 is located below the ladle 31 in position to be filled from the ladle. Thus, after the original tundish 21 has been removed from the casting position, it is possible to swing the preheated, prefilled tundish 27 to casting position without delay and the casting operation may be resumed.

If desired, the ladle 20 may be moved out of casting position during the removal of the tundish from casting position and the ladle 31 may be moved to the casting position previously occupied by the ladle 20 ready to supply metal to the prefilled second tundish.

A modified form of apparatus is shown diagrammatically in FIG. 3. In this form, two tundishes 40 and 41 are provided, each being carried in a carrier (not shown) supported on swing arms 42 and 43, respectively, with the arms 42 rotatably mounted on shaft 44 and the arms 43 rotatably mounted on shaft 45. The centers of shafts 44 and 45 are located on a common center line 46 which is perpendicular to the longitudinal center line 47 of the tundish 40 which is located in casting position.

Each of the tundishes 40 and 41 may be rotated about their respective shafts 44 and 45 through 360° to be located, as desired, in casting position, or in removal position, or in preheating position or in prefill position. In FIG. 3, the tundish 40 is shown in casting position with one end located below the outlet of ladle 48, shown diagrammatically, it being understood that each of the ladles 48, 49 and 50 shown in FIG. 3 are similar to the ladles 20 and 31 of FIG. 2 and are carried on similar ladle cars which ride on rails 18, 18′ as in FIG. 1 so that the ladles may be moved from position to position as required. Ladle 49 is in prefill position for tundish 41 and ladle 50 is in prefill position for tundish 40.

It will also be understood that the tundishes may be removed from their respective carriers and replaced therein by the casting shop crane at any location on their respective turning circles where the tundishes are within the casting shop and clear of obstruction as in FIG. 2. Tundishes may be preheated at any convenient location on their respective turning circles.

A further modification is shown in FIG. 4 in which swing arms 23 of FIG. 2 are replaced by carrier arms 52, 53 rotatably mounted on shaft 54. Each of said carrier arms has a tundish 55, 56 movably mounted thereon. Preferably, each carrier arm has a flat upper surface 57 on which its respective tundish is movable. The tundish movement may be effected by known technology utilizing motor drives or hydraulic power cylinders with the movement guided by rails, for example. As shown in FIG. 4, rails 58, the center of curvature of which is at the center of the outlet opening 59, guide the movement of the tundish to swing about that center. As also shown in FIG. 4, the end of each tundish which has the outlet opening 59 therein protrudes beyond the borders of surface 57 so that the outlet opening has unobstructed access to the mold 60. In the use of this modification, two ladles 61, 62 are used which, as in FIG. 3 are shown diagrammatically, it being understood that each ladle is similar to the ladles 20 and 31 of FIG. 2 and are carried on similar ladle cars which ride on rails 18, 18′ as in FIG. 1 so that the ladles may be moved from position to position as required. As shown in FIG. 4, the tundish 55 carried by arm 52 is able to receive metal from the ladle 61 at one end and to discharge metal into the mold 60 through the outlet 59 at the other end.

At any time when the ladle 61 becomes empty, the tundish 55, preferably while still full of metal, may be swung quickly to the broken line position 55′ beneath the ladle 62 to receive metal therefrom without any interruption of flow of metal from the tundish into the mold.

When it is necessary to remove tundish 55 for repair, carrier arm 52 may be swung in counterclockwise direction to a position where the tundish can be picked up by the casting shop crane. At the same time, carrier arm 53 may be swung in counterclockwise direction to bring the tundish 56 to casting position. Prior to this, the tundish 56 should preferably have been preheated and prefilled so that casting may be resumed with only short interruption.

We claim:

1. In a continuous casting plant comprising a ladle shop, an adjoining separate casting shop, and a separate traveling crane on a separate pair of tracks located within and serving each shop, said pairs of tracks being parallel to each other and separated by a space defining a separation zone between said shops, means for supporting a ladle in said ladle shop, a ladle positioned thereon, means for supporting a mold in said casting shop, at least one mold mounted thereon, and a tundish extending across said separation zone and located at a casting station extending from the ladle shop into the casting shop, one end of said tundish being located below said ladle and the other end of said tundish being located above said mold.

2. A continuous casting plant according to claim 1 including a movable tundish carrier on which said tundish is mounted, said tundish carrier being adapted to move said tundish from its casting station to a removal station within said casting shop.

3. A continuous casting plant according to claim 2 including a second movable tundish carrier, a second tundish mounted thereon, each of said tundish carriers being movable independently to move the respective tundish carried thereby to said tundish casting station and away from said tundish casting station to a tundish removal station.

4. A continuous casting plant according to claim 3 including means for mounting said two movable tundish carriers on a common shaft about which said carriers pivot.

5. A continuous casting plant according to claim 3 including means for mounting said two movable tundish carriers on separate shafts about which said carriers pivot separately.

6. In a continuous casting plant comprising a ladle shop, an adjoining separate casting shop, and a separate traveling crane on a separate pair of tracks located within and serving each shop, said pairs of tracks being parallel to each other and separated by a space defining a separation zone between said shops, means for supporting two ladles side by side in said ladle shop, two ladles positioned thereon, means for supporting a mold in said casting shop, at least one mold mounted thereon, a tundish carrier, a tundish mounted on said carrier and extending across said separation zone and located at a casting station extending from the ladle shop into the casting shop, said tundish being movable on said carrier to position one end of said tundish selectively below the outlet of the first ladle or second ladle and to position the other end of said tundish above said mold.

7. A continuous casting plant according to claim 6 in which said tundish carrier is pivotally mounted.

8. A continuous casting plant according to claim 7 including a second movable tundish carrier, a second tundish mounted thereon, each of said tundish carriers being movable independently to move the respective tundish carried thereby to said tundish casting station and away from said tundish casting station to a tundish removal station within said casting shop.

9. A continuous casting plant according to claim 8 including means for mounting said two movable tundish carriers on a common shaft about which said carriers pivot.

* * * * *